United States Patent [19]

Robinson et al.

[11] Patent Number: 4,807,424

[45] Date of Patent: Feb. 28, 1989

[54] PACKAGING DEVICE AND METHOD

[75] Inventors: Edward A. Robinson; Jesse McLeod, both of Louisville, Ky.

[73] Assignee: Raque Food Systems, Inc., Louisville, Ky.

[21] Appl. No.: 163,258

[22] Filed: Mar. 2, 1988

[51] Int. Cl.[4] ..... B65B 31/02

[52] U.S. Cl. ..... 53/432; 53/289; 53/510

[58] Field of Search ..... 53/73, 289, 329, 432, 53/433, 434, 486, 510, 511, 512

[56] References Cited

U.S. PATENT DOCUMENTS

| | | | |
|---|---|---|---|
| 2,869,301 | 1/1959 | Stover . | |
| 3,246,448 | 4/1966 | Amic . | |
| 3,274,746 | 9/1966 | James et al. . | |
| 3,360,382 | 12/1967 | Miller . | |
| 3,457,694 | 7/1969 | Tatibana | 53/289 X |
| 3,474,595 | 10/1969 | Moroney et al. . | |
| 3,481,100 | 12/1969 | Bergstrom . | |
| 3,540,186 | 11/1970 | Parvin et al. . | |
| 3,657,055 | 4/1972 | Nichols . | |
| 3,659,393 | 5/1972 | Richter . | |
| 3,695,900 | 10/1972 | Young et al. . | |
| 3,708,954 | 1/1973 | Wilke et al. . | |
| 3,712,021 | 1/1973 | Logemann et al. . | |
| 3,820,300 | 6/1974 | Reinecke et al. . | |
| 3,902,302 | 9/1975 | Tartarini . | |
| 3,973,603 | 8/1976 | Franz | 53/289 X |
| 3,992,850 | 11/1976 | Vetter . | |
| 4,009,552 | 3/1977 | Schlachter . | |
| 4,058,953 | 11/1977 | Sanborn, Jr. et al. . | |
| 4,294,859 | 10/1981 | Lundquist et al. . | |
| 4,338,765 | 7/1982 | Ohmori et al. | 53/486 X |
| 4,409,252 | 10/1983 | Buschkens et al. . | |
| 4,472,924 | 9/1984 | Vogele . | |
| 4,624,099 | 11/1986 | Harder . | |
| 4,642,239 | 2/1987 | Ferrar et al. . | |

*Primary Examiner*—Robert L. Spruill
*Assistant Examiner*—Ann Tran
*Attorney, Agent, or Firm*—Barnes & Thornburg

[57] ABSTRACT

A sealing device for covering containers which prior to sealing has a member which reduces the volume of the container and in which the member is released after sealing to allow a vacuum circulation to exist in the sealed container. A further feature provides that the volume reducing, sealing and releasing steps occur while the containers are continuously moved along a conveyor.

16 Claims, 2 Drawing Sheets

PACKAGING DEVICE AND METHOD

BACKGROUND AND SUMMARY OF THE INVENTION

The present invention relates to devices for packaging selected items. More particularly, the present invention relates to a packaging device for continuously packaging selected items in a negative pressure environment.

Conventional devices for continuously sealing containers containing selected items, and in particular, selected food items, have generally not included any provision for creating a slight negative pressure within the sealed container. Generally, such continuous packaging devices have utilized moving heat sealing heads to engage a covering material to the container to seal the container. The resulting sealed container thus has atmospheric pressure within it. This type of sealed container has normally been acceptable to consumers. However, with a wider variety of food items being packaged in containers having a flexible covering material applied by heat sealing head, certain problems have arisen in this type of packaging configuration.

In particular, it is desirable to retort or heat these type of sealed containers when they contain certain types of food items after the containers have been sealed. With certain types of food items, the retorting process can free gases trapped within the material sealed within the container. This freeing of gases during the retorting process can increase the pressure within the sealed container. This increase in pressure within the sealed container can then result in the flexible covering material flexing upwardly somewhat to create a convex or domed configuration.

From a consumer standpoint, the domed configuration of the lid of sealed containers holding food items is undesirable. It is a common misconception by consumers that a domed appearance in a sealed package with a flexible lid indicates that the food item within the sealed container may be unsuitable for human consumption. Although this assumption is normally incorrect, it would be desirable to provide a packaging device which would be capable of sealing a container having a food item with a flexible sealing cover such that a slight negative pressure exists within the sealed container. Then, during a retorting process of the container, any release of gases by the product within the containers would not result in a doming of the flexible sealing cover. It would be particularly advantageous to provide for the slight negative pressure within the sealed container solely by mechanical means, and without any delay or adjustment of the production rate of the packaging machine.

It is therefore one object to the present invention to provide a packaging device that is capable of producing a sealed container with at least a slight negative pressure within the container.

Another object of the present invention is to provide a packaging device that is capable of producing a sealed container with a negative pressure within the container solely by mechanical manipulation of the container.

Yet another object of the present invention is to provide a packaging device that is capable of producing a sealed container with a negative pressure by mechanical manipulation of the container while the containers are moving in a continuous manner.

According to the present invention, a packaging device for sealing a container with a covering material is provided. The device includes means for conveying the container from a filling location to a sealing location. Means are provided for mating the covering material with the container opening to seal the container while the container is continuously moving. In addition, means for reducing temporarily the volume of the container prior to mating the covering material with the container opening are provided to reduce somewhat the pressure within the container after it is sealed.

One feature of the foregoing structure is that means for reducing temporarily the volume of the container are provided. One advantage of this feature is that, after the container is sealed, a slight negative pressure exists within the sealed container.

In preferred embodiments of the present invention, the volume reducing means includes means for deforming temporarily a portion of the container such that the volume of the container is reduced. One advantage of this feature is that the resulting negative pressure within the sealed container is created solely be mechanical manipulation of the container.

Also in preferred embodiments of the present invention, the deforming means includes a lifting assembly which lifts and deforms a bottom portion of the container a distance sufficient to reduce the volume of the container prior to sealing. The reduction in volume of the container is in an amount sufficient to create a negative pressure in the container after the container is sealed and the lifting assembly is disengaged from the container. One advantage of this feature is that, after the sealing is completed, the container is returned to its normal configuration.

Applicants' device is thus capable of packaging a selected item in a sealed container such that a slight negative pressure exists within that sealed container. Applicants' device is capable of continuously conveying the containers along a selected path such that the process is accomplished at a commercially acceptable rate of production. The slight negative pressure with the sealed container is accomplished by temporarily mechanically deforming the container just prior to the sealing process such that the volume within the container is reduced somewhat. After the container has been sealed, the mechanical deformation of the container is eliminated, and the container assumes its normal configuration, which then results in a slight negative pressure within the sealed container. This provides for a slight negative pressure within the container without any intrusion into the container or any interference with the product within that container.

Additional objects, features, and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
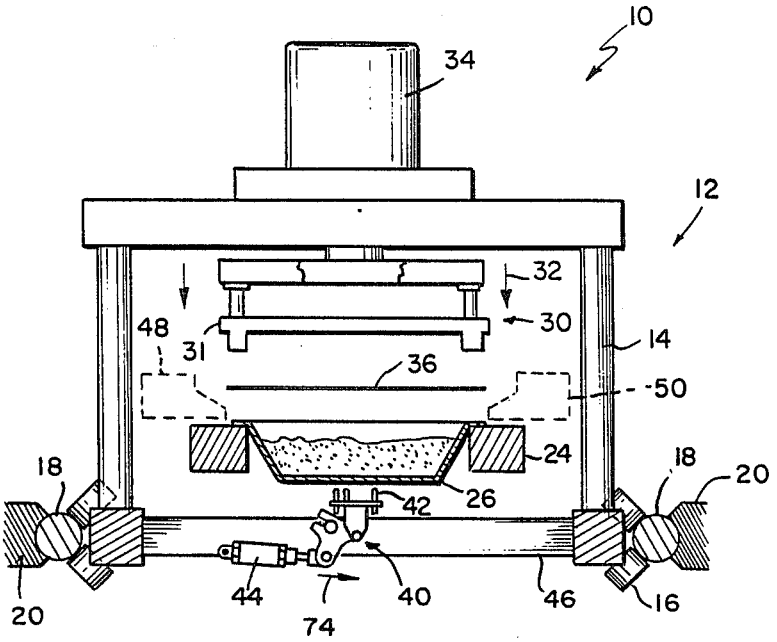
FIG. 1 is an end view of the carriage assembly of the present invention with the stationary rails of the superstructure shown in section.

Referring now to the drawings, and specifically to FIG. 1, FIG. 1 shows a packaging device 10 according to the present invention. the packaging device 10 includes a reciprocating carriage assembly 12 which includes a generally rectangular-shaped frame structure 14. The frame structure 14 includes rollers 16 at both of its bottom corners, with the rollers 16 engaging a respective guide rail 18 for reciprocating movement. The guide rails 18 are part of a superstructure or frame 20 which forms a part of the entire packaging device 10, most of which is not shown. It will be understood that the packaging device 10 is in most aspects a conventional heat seal device which is configured to engage a flexible covering material with a series of continuously moving individual product-filled containers. Because a complete description of the entire packaging device is not included in this detailed description, reference is made to U.S. Pat. No. 4,490,961 which issued to Glen F. Raque on Jan. 1, 1985, the entire specification of which is hereby incorporated by reference. The referenced patent describes in detail a packaging device which includes means for conveying a series of product-filled trays and a reciprocating carriage carrying a selected number of heat sealing heads which act to mate a flexible covering material to each of the product filled containers while the containers are being continuously conveyed.

As described above, the carriage assembly 12 surrounds and reciprocates over a moving conveyor 24 which is configured to convey in one direction a series of product-filled trays 26. As illustrated, the conveyor 24 is specifically configured to support each of the trays 26 by an outer flange or lip of the tray. The conveyor 24 is a continuous conveyor of a conventional type, similar to that described in U.S. Pat. No. 4,490,961 referenced above. The carriage assembly 12 includes a sealing head assembly 30 which includes one or more heat seal heads 31 which are configured to be moved in the direction of arrow 32 by an actuator assembly 34. Although it will be understood that a plurality of heat seal heads 31 may be provided to seal a like number of trays 26, only one heat seal head 31 and one tray 26 will be discussed as representation of the operation of the device 10.

Specifically, the heat seal head 31 is configured to move toward the continuously conveyed tray 26 to engage a flexible covering material 36 with the tray 26 to seal the tray 26. The covering material 36 is continuously conveyed across the top of the moving tray 26 with the speed of the covering material 36 matching the speed of the moving tray 26. The apparatus for providing and moving the covering material 36 is not shown, however, this process is described in referenced U.S. Pat. No. 4,490,961.

It will be understood that it is conventional for a packaging device such as that illustrated in FIG. 1 to seal product-filled containers with a flexible covering material such as covering material 36 with heat seal heads such as the heat seal head 31. The carriage assembly 12 is configured to reciprocate over the conveyor 24 and moving trays 26 such that during the sealing operation, the carriage assembly 12 matches both speed and direction of the moving trays 26. By matching both speed and direction of the moving trays 26, as the heat seal heads 31 move downwardly and engage the covering material 36 with the trays 26 to accomplish the sealing operation, no delay or adjustment in the speed of the moving trays 26 is necessary. This permits the stream of moving trays 26 to be conveyed in a uniform manner which increases the productivity of the apparatus. After the sealing operation, the heat seal heads 31 retract upwardly and the carriage assembly 12 then moves in an opposite direction of the movement of the trays 26 to reposition itself for the next sealing operation with the carriage assembly 12 again matching the speed and direction of the moving trays 26. Again, this type of operation is conventional, and is specifically described in referenced U.S. Pat. No. 4,490,961.

In such a conventional operation, it is normally not possible to seal the individual tray 26 with any sort of resulting internal negative pressure. It is known to provide for a controlled atmosphere within the trays, such as by providing a vacuum gallery 48 and a gas inlet gallery 50 as shown in dotted line in FIG. 1. By providing the galleries 48, 50, it is possible to package the sealed trays 26 such that a controlled environment of inert gas is sealed within each of the trays 26. However, it has been found that it is advantageous to be able to create a slight negative pressure within the sealed trays 26, whether or not a controlled atmosphere has been sealed within the trays 26. The slight negative pressure is advantageous because, if a sealed tray is retorted, gases may be released from the food product within the sealed trays 26 which can create an increase in pressure within the sealed trays 26. An increase in pressure in a sealed tray which was sealed with atmospheric pressure within the tray 26, results in a slight doming or convex configuration of the cover. This doming of the cover is disadvantageous from a consumer desirability standpoint. However, if the tray 26 is sealed with a slight negative pressure, and then the sealed tray 26 is retorted, a slight increase in pressure due to the retorting process does not result in the cover of the sealed tray 26 being domed. Specifically, the amount of negative pressure sealed within the trays 26 can be selected such that after the retorting process, the pressure within the tray is no greater than atmospheric. This prevents any doming or convex configuration of the covering of the tray 26.

To provide the slight negative pressure within a sealed tray 26, a lifting assembly 40 is provided in the packaging device 10. The lifting assembly 40 includes lifting pins 42 which are oriented and configured to engage a bottom wall of the tray 26. The lifting pins 42 are moved upwardly when desired by an actuator cylinder 44, which in the preferred embodiment is an air-driven actuator cylinder. The actuator cylinder 44 is attached between two of the cross members 46 (only one of which is shown in FIG. 1) of the carriage assembly 12. The details of the lifting assembly 40 will be discussed in more detail below.

As discussed above, the packaging device 10 may optionally include a vacuum gallery 48 and/or a gas inlet gallery 50 which are disposed on opposite sides of the moving conveyor 24. The function of the vacuum gallery 48 and gas inlet gallery 50 to provide a controlled environment within the sealed trays 26 is discussed in detail in a copending patent application assigned to the assignee of the present application and identified as a Ser. No. 07/041,860 filed Apr. 22, 1987, the entire specification of which is hereby incorporated by reference.

Figure 2:
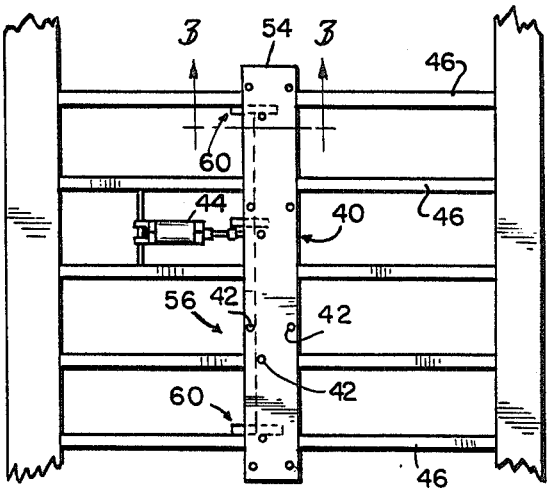
FIG. 2 is a top plan view of a portion of the carriage assembly illustrating the lifting assembly.

FIG. 2 shows in more detail the lifting assembly 40. Specifically, the lifting assembly 40 includes a base plate 54 which extends in a parallel, spaced-apart relation to the moving conveyor 24 (FIG. 1). The lifting pins 42 are mounted in the base plate 54 and extend upwardly from the base plate 54 toward the trays 26. In the preferred embodiment, the pins 42 are divided into groups 56 of three pins each, with each three pins designated to engage one of the trays 26. It will be understood that different pin configurations are possible as well as different numbers of pins within each group. The number and configuration of the pins is selected depending upon the size and configuration of the trays 26, as well as the number of sealing heads 31. Specifically, if four sealing heads 31 are provided which engage four trays 26 simultaneously, then four groups 56 of lifting pins 42 must also be provided. This configuration is illustrated in FIG. 2 with four groups 56 of three lifting pins 42 each.

Although not shown, if only one sealing head 31 is provided for engaging and sealing one tray 26, then only one group 56 of three pins 42 need to be provided. It will be further understood that the number of pins 42 in each group 56 of pins can be a number different than three, however, for the type of trays 26 illustrated in FIG. 1, three pins 42 have been found to be a desired number. With three pins 42 in a group 56, the tray 26 can be engaged and lifted upwardly from the conveyor 24 without any tipping or instability. If the tray 26 includes individualized compartments, then the number of pins 42, and their configuration may be changed to engage only a selected number of the compartments or pockets within the tray 26, if desired.

As can be seen in FIG. 2, only one actuator cylinder 44 is necessary to raise and lower the base plate 54. As discussed above, the actuator cylinder 44 is mounted between two cross members 46 of the carriage assembly 12. To enable the base plate 54 to be elevated and lowered smoothly by the actuator cylinder 44, two idler assemblies 60 are mounted on other cross members 46 near the opposite ends of the base plate 54. These idler assemblies 60, and their relation to the base plate 54 and actuator assembly 44 are described below in the discussion related to FIG. 3.

Figure 3:
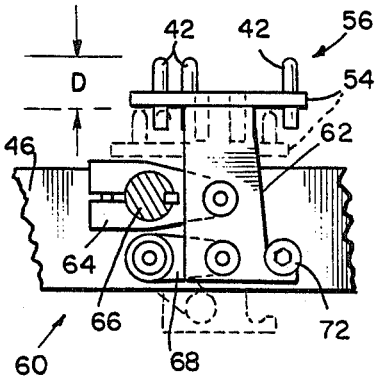
FIG. 3 is a sectional view taken through lines 3—3 of FIG. 2.

FIG. 3 shows in more detail one of the idler assemblies 60. Each idler assembly 60 includes a generally vertical lever arm 62 which is attached directly to the base plate 54. A crank arm 64 is pivotly attached to the lever arm 62, with the crank arm 64 being attached to and moved by a rotating pivot shaft 66. The pivot shaft 66 extends in a parallel, spaced-apart relation to the base plate 54, and is rotationally driven by the actuator cylinder 44. An idler arm 68 is also pivotly attached to the lever arm 62 and is provided to maintain the lever arm 62 in a generally vertical orientation during upward and downward movement. A shoulder stop 72 is provided which is configured to engage a lower portion of the lever arm 62 to limit upward travel of the lever arm 62 and consequently upward travel of the base plate 54. It will be understood that the shoulder stop 72 can be adjusted such that upward travel of the lever arm 62 and base plate 54 can be adjusted depending upon the desired upward movement of the pins 42.

To raise the base plate 54 and pins 42, the actuator cylinder 44 is extended in the direction of arrow 74 (FIG. 1) which rotates the pivot shaft 66 in a counterclockwise direction. The attached crank arm 64 then moves the lever arm 62 and attached base plate 54 upwardly. The limit of upward travel is controlled by the location of a shoulder stop 72. In FIG. 3, base plate 54 and pins 42 are shown in solid line in their uppermost or extended position, and shown in dotted line in their lowered position. The amount of movement between the lowered position and the upper or extended position is indicated by the dimension D. In the preferred embodiment, this dimension D is approximately 0.6 inches (1.52 cm). It will be understood that this distance can be adjusted depending upon the type of tray and the size of tray and the clearance between the tray 26 and the pins 42, and further depending upon the amount of deflection desired in the bottom portion of the tray 26 which controls somewhat the amount of negative pressure created in the tray 26 after sealing.

Figure 4:
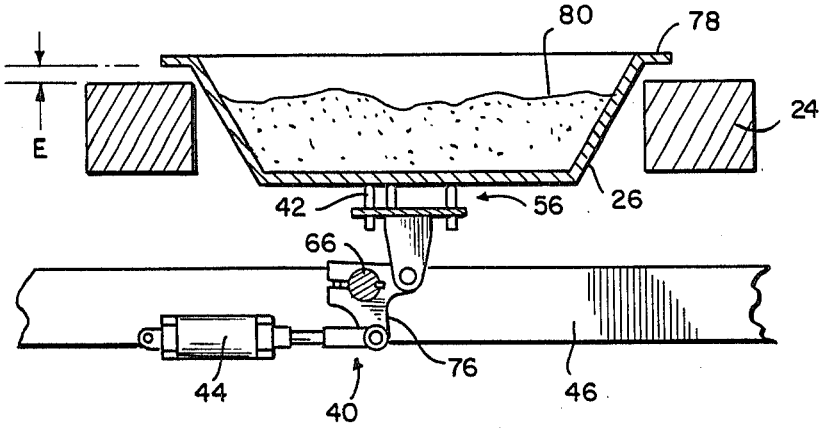
FIG. 4 is a sectional view through a tray and a lifting assembly illustrating a pre-seal lifting stage.

FIG. 4 illustrates a pre-sealing step of lifting the tray 26 off of the conveyor 24. In addition, FIG. 4 illustrates in greater detail certain aspects of the lifting assembly 40. Specifically, the lifting assembly 40 includes a bell crank 76 which is directly attached to an end of the actuator cylinder 44. The bell crank 76 is securely attached to the pivot shaft 66 and acts to rotate the pivot shaft 66 upon actuation of the actuation cylinder 44 in a known manner.

In operation, before the heat seal head 31 lowers to be in contact with a lip 78 of the tray 26, the actuator cylinder 44 extends to raise the base plate 54 and group of lifting pins 56 upwardly, which lifts the tray 26 containing a product material 80 off of the conveyor 24. The tray 26 is lifted off of the conveyor 24 a distance indicated by the dimension E. In the preferred embodiment, this dimension E is approximately 0.1 inches (0.254 cm). It will be understood that the difference between the dimension D (FIG. 3) and the dimension E is basically a clearance dimension which indicates the clearance between the bottom of the tray and the top of the pins 42 when the base plate 54 is in its lower position. The lifting of the tray 26 by the lifting assembly 40 takes place during the period when the carriage assembly 12 is moving in the same direction and at the same speed as the conveyor 24 and trays 26. Thus, the lifting assembly 40 will be moving in the same direction and the same speed as the moving trays 26. When the tray 26 is lifted by the pins 42, there is thus no relative movement resulting between the lifted tray 26 and the conveyor 24. This permits the device 10 to be operated at a constant rate of movement of the trays 26, which is advantageous in that the production rate of the device 10 is optimized.

Figure 5:
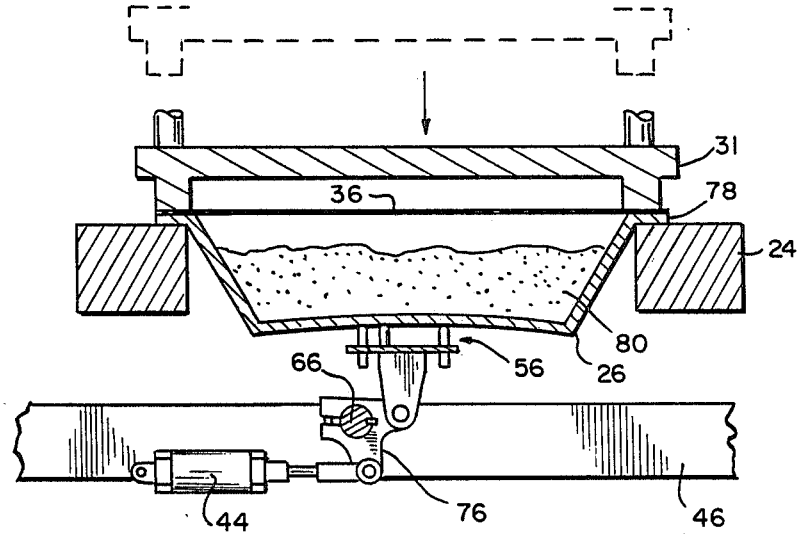
FIG. 5 is a view similar to FIG. 4 illustrating the sealing stage.

FIG. 5 illustrates the sealing and deforming step in greater detail. Specifically, as the heat seal head 31 lowers to mate the moving covering material 36 with the lip 78 of the tray 26 the covering material 36 and the lip 78 are sandwiched between the moving conveyor 26 and the heat seal head 31. Because the tray 26 and lip 78 have been elevated as illustrated in FIG. 4, depressing and sandwiching the lip 78 between the heat seal head 31 and the conveyor 24 results in the bottom portion of the tray 26 being deformed upwardly. This upward deformation of the bottom of the tray 26 results in a reduction in the volume within the tray 26.

It will be understood that, because the actual sealing of the covering material 36 to the lip 78 does not occur until after the lip 78 is firmly sandwiched between the conveyor 24 and the heat seal head 31, the deformation of the bottom portion of the tray 26 has already taken place before this actual sealing occurs. Thus, by deforming the bottom portion of the tray 26 prior to actual sealing of the covering material 36 with the lip 78 of the tray 26, the reduction in volume of the tray 26 results in a certain amount of air being expelled from the tray 26. Thus, when the actual sealing between the covering material 36 and the lip 78 of the tray 26 occurs, the pressure within the deformed sealed tray 26, is substantially atmospheric pressure.

In a packaging device of the type that includes a gas flush gallery such as the gas inlet gallery 50 illustrated in FIG. 1 in dotted line, the gas flush may cause a slight increased pressure within the tray 26 as it is sealed. This slight increased pressure can be easily compensated for by adjusting the amount of deformation of the bottom wall of the tray 26 as will be described below.

Figure 6:
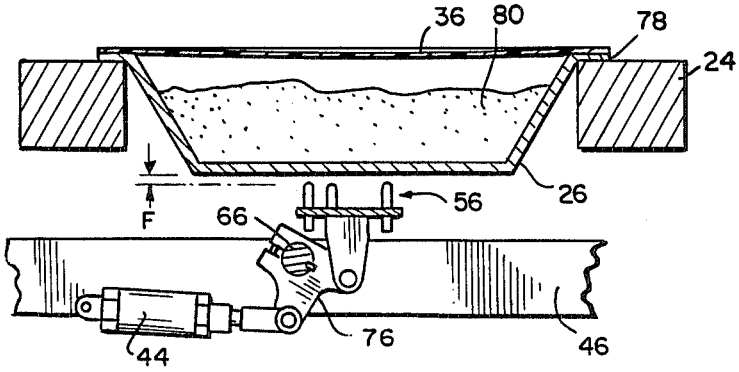
FIG. 6 is a view similar to FIG. 5 showing a sealed container with the lifting assembly disengaged from the container.

FIG. 6 shows the post-sealing step in which the sealing head 31 (FIG. 5) has been lifted away from the lip 78 after the covering material 36 has been sealed around the lip 78. In addition, the pins 42 have been lowered by the actuator cylinder 44 from the bottom portion of the tray 26. The clearance dimension between the bottom of the tray 26 and the top of the pins 42 is represented by dimension F. Because of the resilient characteristics of the tray 26, the bottom wall resumes its original, substantially planar configuration. When the bottom wall of the tray 26 resumes this original configuration, the volume within the tray 26 increases. Because the covering material 36 has sealed the tray 26, the increase in volume within the tray creates a slight negative pressure within the sealed tray 26. This slight negative pressure within the sealed tray 26 causes the flexible covering material 36 to assume a slightly depressed or concave configuration. This configuration of the covering material 36 is illustrated in FIG. 6.

As it will be understood, the amount of deformation of the bottom portion of the tray 26 controls primarily the resulting negative pressure within the sealed tray 26. If the tray 26 is sealed with a slight positive pressure with a gas flush device as discussed above, then the deformation of the tray 26 can be adjusted such that when the pins 42 are lowered and the tray 26 assumes its original configuration, a net negative pressure is created within the tray 26. Thus, it is possible to select the desired negative pressure within the sealed trays 26 and adjust the device 10 accordingly. The sealed tray 26, as shown in FIG. 6, can then be retorted without a resulting positive pressure within the tray 26 which could result in a domed appearance of the covering material 36. Again, it is possible to select the amount of negative pressure depending upon the anticipated increase in pressure within the tray 26 during the retorting process. So long as the negative pressure within the sealed tray 26 is greater in value than the increase in pressure during the retorting process, the end result will be a product-containing tray 26 which does not have a positive sealed pressure.

Thus, the present invention is capable of providing a sealed, product-containing tray which has a slight negative pressure. The sealed tray can then be retorted and still not assume a positive pressure condition which would result in a domed cover which is highly undesirable. The slight negative pressure in the sealed tray is achieved by temporary mechanical deformation of the tray without any permanent change in characteristics of the tray whatsoever. In addition, the device is capable of deforming the tray while the trays are moving at a normal production rate.

What is claimed is:

1. In a packaging device which includes a conveyor for moving a series of containers, each having a volume, and a sealing head which mates a covering material with a material-receiving opening in each container while the container is being moved by the conveyor to seal the container, the improvement comprising means moving with the container for reducing the volume of the container prior to sealing and means for releasing the reducing means after sealing, thereby creating a vacuum in the sealed container.

2. A packaging device for sealing a container with a covering material, the device comprising:

means for continuously conveying the container from a filling location through a sealing location, means for mating a covering material with an upwardly-facing material-receiving opening of the container to seal the container while the container is conveyed through the sealing location, and means for reducing temporarily the volume of the continuous conveyed container prior to sealing the covering material with the container opening, means for releasing the reducing means after the covering material has been sealed with the container opening to permit the container to assume its original volume such that the pressure within the sealed container is reduced somewhat below atmospheric pressure.

3. The packaging device of claim 2, wherein the reducing means includes means for deforming temporarily a portion of the container such that the volume of the container is reduced.

4. The packaging device of claim 3, wherein the deforming means comprises a lifting assembly which engages a bottom portion of the container.

5. The packaging device of claim 4, wherein the lifting assembly comprises a lifting plate disposed below the container that raises to engage and lift the bottom portion of the container prior to the mating of the covering material with the container opening.

6. The packaging device of claim 5, wherein the lifting plate lifts the bottom portion of the container a distance sufficient to reduce the volume of the container prior to sealing an amount sufficient to create a negative pressure in the container after the container is sealed and the lifting plate is lowered.

7. The packaging device of claim 4, further comprising means for moving the lifting assembly in the same direction and at the same speed as the conveying means while the lifting assembly is engaging the container.

8. The method of creating a vacuum in a product filled container having a somewhat flexible container portion and a sealing cover portion, the method comprising the steps of, filling the container portion with the desired product, continuously moving the container portion from filling through a sealing step, lifting and supporting the container while it moves by engaging a bottom wall of the container portion with a lifting assembly, orienting the sealing cover over a top opening of the moving container portion, engaging the top opening of the moving container portion and the sealing cover with a sealing head and forcing the moving container toward the lifting assembly with sufficient force to deform somewhat the bottom wall of the container and to seal the cover to the container opening, and disengaging the lifting assembly from the bottom wall of the moving container to permit the bottom wall to return to its undeformed orientation thereby creating a vacuum in the sealed container.

9. A heat seal apparatus for producing sealed containers having a negative pressure in an inner region of the sealer containers, the apparatus comprising:

means for continuously conveying a series of resilient containers having an inner region with a bottom portion having a substantially planar configuration along a path, means for mating the continuously conveyed containers with a covering material to seal the inner region, and means for lifting the continuously conveyed containers prior to sealing the continuously conveyed containers, the lift means cooperating with the mating means to deflect the bottom portion of the continuously conveyed containers upward to force air from the inner region prior to sealing the containers to reduce the volume of the inner region, and means for releasing the lifting means after the continuously conveyed container is sealed to permit the bottom portion of the container to assume its original planar configuration such that a negative pressure is created within the sealed container.

10. The apparatus of claim 9, wherein the containers are formed to include an outer lip extending over an edge of the conveying means, and the mating means includes a sealing head assembly which acts to form the sealed inner region by pressing the covering material and the outer lip of the corresponding container downwardly against the conveying means to heat seal the containers, the lifting means including a container engaging means for engaging the bottom portion of the container and means for moving the engaging means from a lower position to an upper position to raise the outer lip of the containers above the conveying means prior to the sealing head assembly pressing downward on the containers so that, upon the application of downward pressure by the sealing head assembly, the bottom portion of the container is deflected upwardly to reduce the volume of the inner region, thereby forcing air from the inner region of the container and creating a negative pressure in the inner region when the containers are sealed and the lifting means is lowered so that the bottom portion is no longer deflected upward.

11. The apparatus of claim 10, wherein the containers are continuously conveyed in a predetermined direction at a predetermined speed and further comprising means for conveying the lifting means in the same predetermined direction at the same predetermined speed as the containers while the lifting means is engaging the containers.

12. A packaging device for sealing a container with a covering material, the device comprising, means for conveying the container from a filling location to a sealing location, means for mating a covering material with an upwardly-facing material-receiving opening of the container to seal the container, means for reducing temporarily the volume of the container by deforming a portion of the container such that the volume of the container is reduced, prior to sealing the covering material with the container opening, which comprises a lifting plate disposed below the container that raises to engage and lift the bottom portion of the container prior to the mating of the covering material with the container opening, and means for releasing the reducing means after the covering material has been sealed with the container opening to permit the container to assume its original volume such that the pressure within the sealed container is reduced somewhat below atmospheric pressure.

13. The packaging device of claim 12, wherein the lifting plate lifts the bottom portion of the container a distance sufficient to reduce the volume of the container prior to sealing an amount sufficient to create a negative pressure in the container after the container is sealed and the lifting plate is lowered.

14. A packaging device for sealing a container with a covering material, the device comprising, means for conveying the container from a filling location to a sealing location, means for mating a covering material with an upwardly-facing material-receiving opening of the container to seal the container, means for reducing temporarily the volume of the container by deforming a portion of the container such that the volume of the container is reduced, prior to sealing the covering material with the container opening, the deforming means comprising a lifting assembly which engages a bottom portion of the container, means for releasing the reducing means after the covering material has been sealed with the container opening to permit the container to assume its original volume such that the pressure within the sealed container is reduced somewhat below atmospheric pressure, and further comprising means for moving the lifting assembly in the same direction and at the same speed as the conveying means while the lifting assembly is engaging the container.

15. A heat seal apparatus for producing sealed containers having a negative pressure in an inner region of the sealer containers, the apparatus comprising, means for conveying a series of resilient containers having an inner region with a bottom portion having a substantially planar configuration along a path, means for mating the containers with a covering material to seal the inner region, and means for lifting the containers prior to sealing the containers, the lift means cooperating with the mating means to deflect the bottom portion of the containers upward to force air from the inner region prior to sealing the containers to reduce the volume of the inner region, and means for releasing the lifting means after the container is sealed to permit the bottom portion of the container to assume its original planar configuration such that a negative pressure is created within the sealed container, wherein the containers are formed to include an outer lip extending over an edge of the conveying means, and the mating means includes a sealing head assembly which acts to form the sealed inner region by pressing the covering material and the outer lip of the corresponding container downardly against the conveying means to heat seal the containers, the lifting means including a container engaging means for engaging the bottom portion of the container and means for moving the engaging means from a lower position to an upper position to raise the outer lip of the containers above the conveying means prior to the sealing head assembly pressing downward on the containers so that, upon the application of downward pressure by the sealing head assembly, the bottom portion of the container is deflected upwardly to reduce the volume of the inner region, thereby forcing air from the inner region of the container and creating a negative pressure in the inner region when the containers are sealed and the lifting means is lowered so that the bottom portion is no longer deflected upward.

16. The apparatus of claim 15, wherein the containers are continuously conveyed in a predetermined direction at a predetermined speed and further comprising means for conveying the lifting means in the same predetermined direction at the same predetermined speed as the containers while the lifting means is engaging the containers.

* * * * *